US005499619A

United States Patent [19]

Tarta

[11] Patent Number: 5,499,619

[45] Date of Patent: Mar. 19, 1996

[54] UNDERWATER DART GUN

[76] Inventor: Joseph A. Tarta, 991 E. Saddle River Rd., Hohokus, N.J. 07423

[21] Appl. No.: 354,485

[22] Filed: Dec. 12, 1994

[51] Int. Cl.[6] ..... F41B 11/08

[52] U.S. Cl. ..... 124/57; 124/71; 43/6

[58] Field of Search ..... 124/56, 57, 71; 43/4.5, 6, 19

[56] References Cited

U.S. PATENT DOCUMENTS

| | | | |
|---|---|---|---|
| 2,957,468 | 10/1960 | Enfield | 124/57 |
| 2,964,031 | 12/1960 | Dotson | 124/57 |
| 2,970,399 | 2/1961 | Frohlich et al. | 43/6 |
| 3,142,293 | 7/1964 | Harter | 124/57 |
| 3,417,719 | 12/1968 | Nitenson | 124/57 X |
| 3,830,214 | 8/1974 | Curtis | 124/57 |

*Primary Examiner*—Randolph A. Reese
*Assistant Examiner*—John A. Ricci

[57] ABSTRACT

A gun for projecting a dart underwater to inject a gas into an underwater animal. The inventive device includes a gun body having a barrel projecting therefrom. A dart having a pressurized propellant is punctured by the gun and caused to exit the gun barrel. Upon striking a fish, the dart injects a volume of gas into the fish to disable and render buoyant the fish for capture. The device can be utilized for self defense, as well as for hunting and capturing of underwater animals and/or fish.

17 Claims, 3 Drawing Sheets

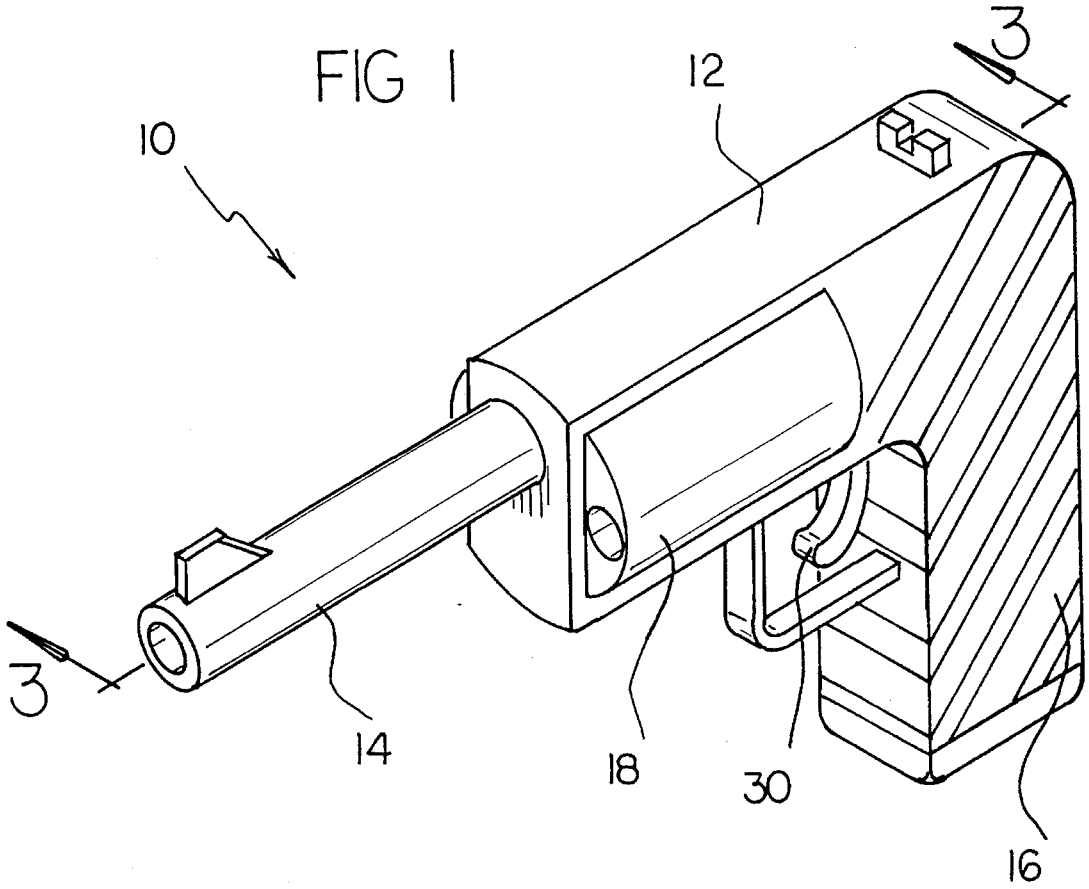
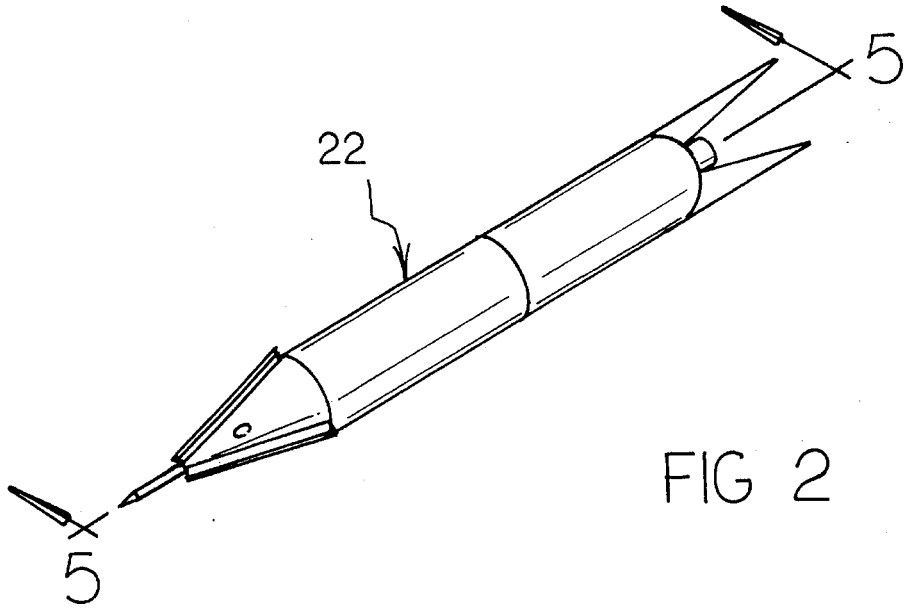
FIG 2

FIG 3
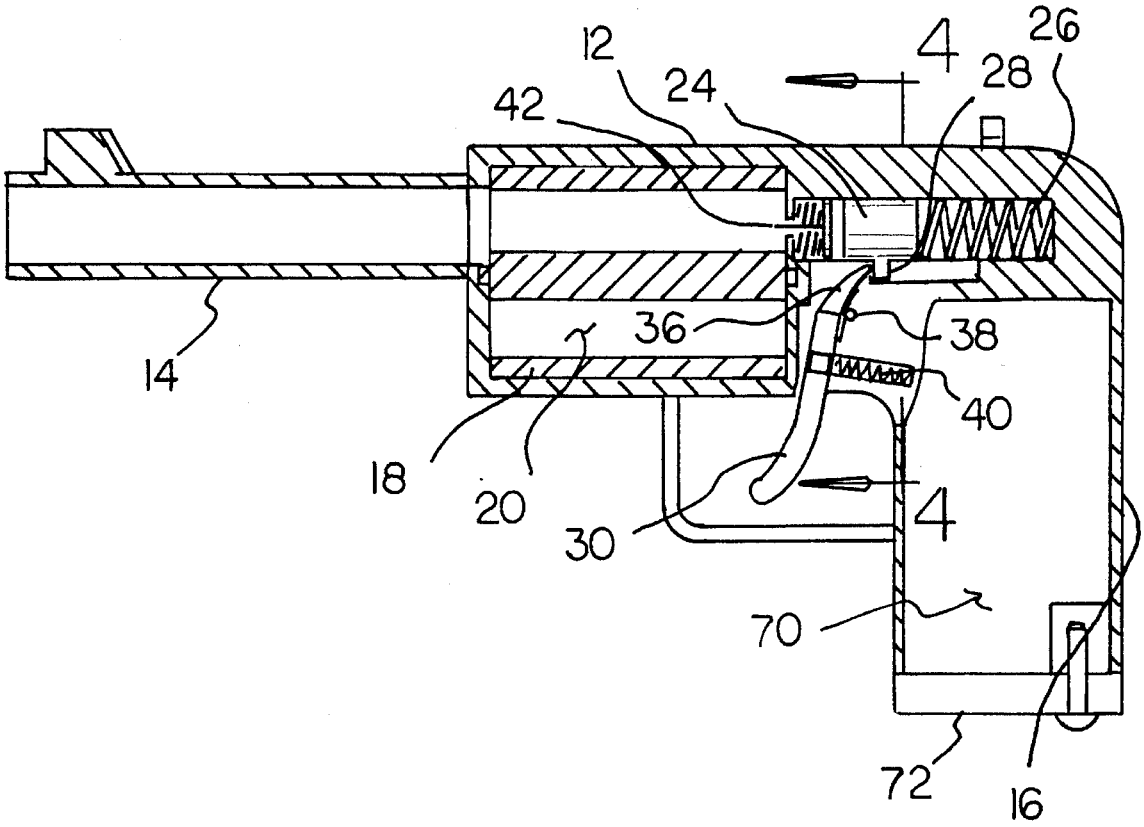
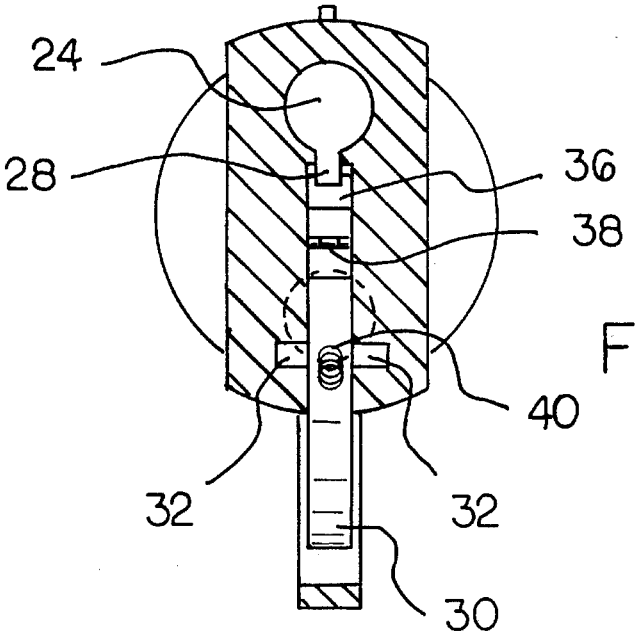
FIG 4

FIG 5
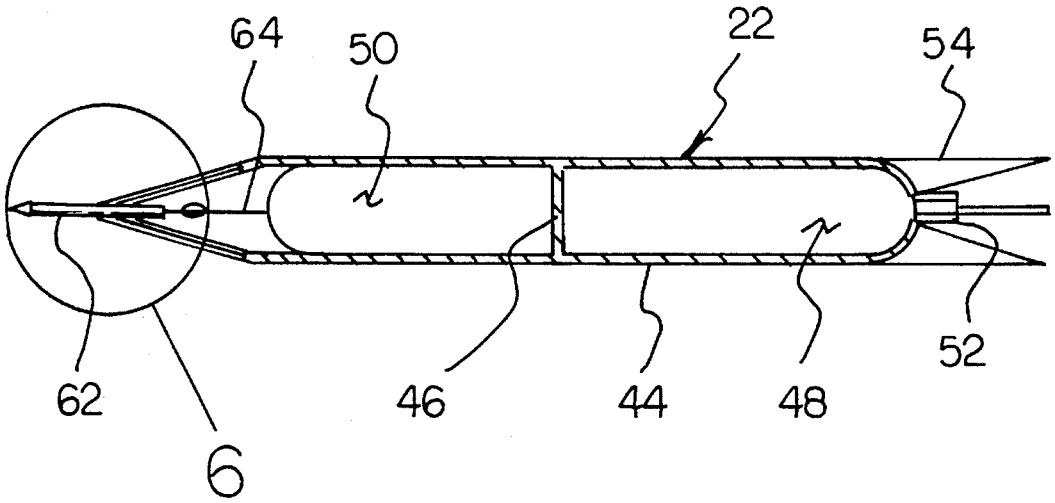
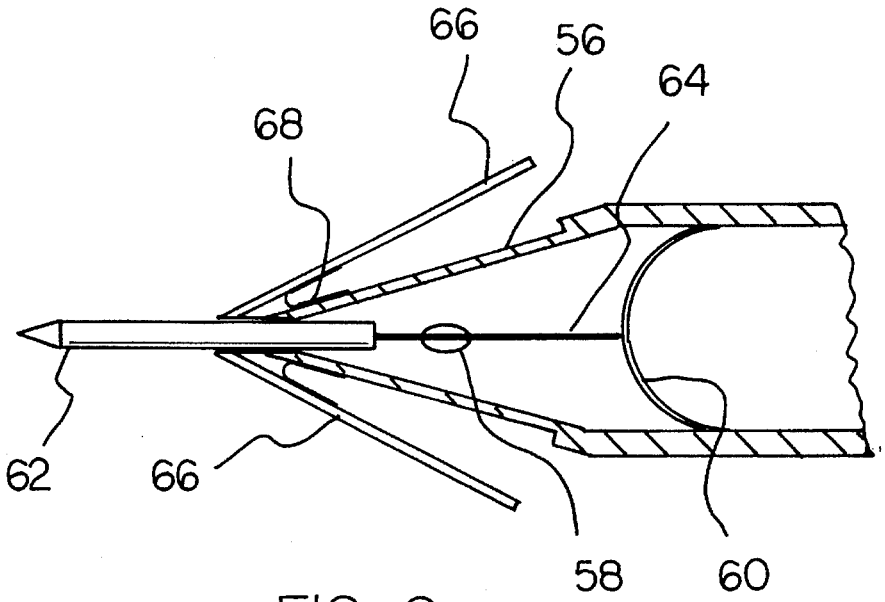
FIG 6

UNDERWATER DART GUN

BACKGROUND OF THE INVENTION

1. Field of the Invention

The present invention relates to fire arm structures and more particularly pertains to an underwater dart gun for projecting a dart underwater to inject a gas into an underwater animal.

2. Description of the Prior Art

The use of fire arm structures is known in the prior art. More specifically, fire arm structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art fire arm structures include U.S. Pat. No. 4,821,441; U.S. Pat. No. 4,266,358; U.S. Pat. No. 4,100,692; U.S. Pat. No. 3,735,747; and U.S. Pat. No. 3,453,763.

While these devices fulfill their respective, particular objectives and requirements, the aforementioned patents do not disclose an underwater dart gun for projecting a dart to inject a gas into an underwater animal which includes a gun body having a barrel projecting therefrom, and a dart having a pressurized propellant punctured by the gun and caused to exit the gun barrel, wherein the dart injects a volume of gas into a fish to disable and render buoyant the fish for capture or self defense purposes.

In these respects, the underwater dart gun according to the present invention substantially departs from the conventional concepts and designs of the prior art, and in so doing provides an apparatus primarily developed for the purpose of projecting a dart underwater to inject a gas into an underwater animal.

SUMMARY OF THE INVENTION

In view of the foregoing disadvantages inherent in the known types of fire arm structures now present in the prior art, the present invention provides a new underwater dart gun construction wherein the same can be utilized for projecting a dart to inject into an underwater animal. As such, the general purpose of the present invention, which will be described subsequently in greater detail, is to provide a new underwater dart gun apparatus and method which has many of the advantages of the fire arm structures mentioned heretofore and many novel features that result in an underwater dart gun which is not anticipated, rendered obvious, suggested, or even implied by any of the prior art fire arm structures, either alone or in any combination thereof.

To attain this, the present invention generally comprises a gun for projecting a dart underwater to inject a gas into an underwater animal. The inventive device includes a gun body having a barrel projecting therefrom. A dart having a pressurized propellant is punctured by the gun and caused to exit the gun barrel. Upon striking a fish, the dart injects a volume of gas into the fish to disable and render buoyant the fish for capture. The device can be utilized for self defense, as well as for hunting and capturing of underwater animals and/or fish.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new underwater dart gun apparatus and method which has many of the advantages of the fire arm structures mentioned heretofore and many novel features that result in an underwater dart gun which is not anticipated, rendered obvious, suggested, or even implied by any of the prior art fire arm structures, either alone or in any combination thereof.

It is another object of the present invention to provide a new underwater dart gun which may be easily and efficiently manufactured and marketed.

It is a further object of the present invention to provide a new underwater dart gun which is of a durable and reliable construction.

An even further object of the present invention is to provide a new underwater dart gun which is susceptible of a low cost of manufacture with regard to both materials and labor, and which accordingly is then susceptible of low prices of sale to the consuming public, thereby making such underwater dart guns economically available to the buying public.

Still yet another object of the present invention is to provide a new underwater dart gun which provides in the apparatuses and methods of the prior art some of the advantages thereof, while simultaneously overcoming some of the disadvantages normally associated therewith.

Still another object of the present invention is to provide a new underwater dart gun for projecting a dart to inject a gas into an underwater animal.

Yet another object of the present invention is to provide a new underwater dart gun which includes a gun body having a barrel projecting therefrom, and a dart having a pressurized propellant punctured by the gun and caused to exit the gun barrel, wherein the dart injects a volume of gas into a fish to disable and render buoyant the fish for capture.

Even still yet another object of the present invention is to provide a new underwater dart gun which can be utilized against underwater animals and/or fish in self defense by a swimmer or diver.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration an underwater dart gun according to the present invention.

FIG. 2 is an isometric illustration of a dart forming a portion of the present invention.

FIG. 3 is a cross-sectional view taken along line 3—3 of FIG. 1.

FIG. 4 is a further cross-sectional view taken along line 4—4 of FIG. 3.

FIG. 5 is a cross-sectional view of the dart taken along line 5—5 of FIG. 2.

FIG. 6 is an enlarged view of the area set forth in FIG. 5.

DESCRIPTION OF THE PREFERRED EMBODIMENT

With reference now to the drawings, and in particular to FIGS. 1–6 thereof, a new underwater dart gun embodying the principles and concepts of the present invention and generally designated by the reference numeral 10 will be described.

More specifically, it will be noted that the underwater dart gun 10 comprises a gun body 12 having a barrel 14 projecting therefrom. The gun body 12 is shaped so as to define a depending handle 16 which can be grasped and manipulated by an individual during use of the device 10. A revolving magazine 18 is rotatably supported within a transverse aperture formed in the gun body 12 and includes a plurality of chambers 20, each of which can be rotatably positioned into alignment with the barrel 14, as shown in the cross section illustration of FIG. 3. The chambers 20 are each operable to receive an individual one of a plurality of darts 22, such as is illustrated in FIG. 2, for propulsion from the gun body 12 through the barrel 14.

As best illustrated in FIGS. 3 and 4, it can be shown that the gun body 12 is shaped so as to define a cylindrical bore positioned into alignment with the barrel 14 and one of the chambers 20 of the magazine 18. A hammer 24 of substantially solid cylindrical construction is slidably mounted within the cylindrical bore of the gun body 12. A hammer spring 26 is interposed between the hammer 24 and a closed end of the cylindrical bore. The hammer 24 includes a depending projection 28 extending substantially orthogonally therefrom which can be engaged by a portion of a trigger 30 to effect compression of the hammer spring 26. To this end, the trigger 30 is shaped so as to define a pair of lateral projections 32 extending outwardly therefrom which reside within respectively opposed and unlabeled trigger slots formed within the gun body 12. A catch 36 is pivotally and resiliently mounted to an upper end of the trigger 30 by a spring loaded hinge 38 and is positioned for engagement with the depending projection 28 of the hammer 24. By this structure, a movement of the trigger 30 towards the handle 16 of the gun body 12 will bias the hammer 24 against a force of the hammer spring 26. Because the trigger slots 34 are oriented at an oblique angle relative to a longitudinal axis of the cylindrical bore within which the hammer 24 is slidably mounted, the catch 36 will eventually be biased to a position beneath the depending projection 28, whereby a hammer spring 26 will force the hammer 24 towards an open end of the cylindrical bore. A return spring 40 interposed between the trigger 30 and a portion of the gun body 12 biases the trigger 30 away from the handle 16, with the hinge 38 permitting a resilient deflection of the catch 36 over the depending projection 28 and into position for additional actuation thereof. If desired, suitable means for rotating the revolving magazine 18 in response to a movement of the trigger 30 can also be incorporated into the present invention 10.

As the hammer 24 is forced forward towards the open end of the cylindrical bore by the hammer spring 26, it will contact a firing pin 42 supported therein upon an unlabelled coil spring. Consequently, an impacting of the hammer 24 against the firing pin 42 will result in initiation of the propulsion of the dart 22 in a manner which will subsequently be described in more detail.

Referring now to FIGS. 5 and 6 wherein an individual one of the darts 22 is illustrated in detail, it can be shown that each of the darts preferably comprises a substantially cylindrical body 44 having a dividing wall 46 extending across an interior thereof to separate the interior of the cylindrical body into a propellant chamber 48 and an injection chamber 50. A rear end of the cylindrical body 44 is shaped so as to define a nozzle 52 having an unlabelled frangible seal extending thereacross. Thus, the frangible seal can be punctured by the firing pin 42 to permit expulsion of a pressurized gas such as carbon dioxide from the propellant chamber 48 through the nozzle 52 to accelerate the dart 22 from the gun body 12 through the barrel 14. The dart 22 preferably includes a plurality of guide fins 54 projecting from the rear end of the cylindrical body 44 which operate to stabilize the dart by imparting a rotational spin thereto. In other words, the guide fins 54 are oriented at an oblique angle relative to a longitudinal axis directed through the cylindrical body 44 so as to aerodynamically rotate the dart 22 as it travels through a fluid medium.

A front end of the cylindrical body 44 of the dart 22 is shaped so as to define a conical nose 56, as illustrated in FIG. 6. A plurality of dispensing apertures 58 are directed through the conical nose 56 and permit egress of a pressurized gas contained within the injection chamber 50 upon a puncturing of a frangible wall 60 extending across the injection chamber. As shown in FIG. 6, the frangible wall 60 is preferably concave in shape relative to an interior of the injection chamber 50 so as to facilitate retention of the pressurized gas within the injection chamber while remaining relatively frangible. The conical nose 56 of the cylindrical body 44 terminates at an unlabelled center aperture through which a piercing tip 62 is movably mounted. The piercing tip 62 extends into the conical nose 56 and is coupled to a detonation pin 64 positioned for sliding engagement into the frangible wall 60. By this structure, an impacting of the piercing tip 62 against or into an underwater animal, such as a fish or the like, will bias the piercing tip 62 into the conical nose 56 to cause the detonation pin 64 to pierce the frangible wall 60. The pressurized gas contained within the injection chamber 50 will then be released through the dispensing apertures 58 and into the associated underwater animal. Such injection of a pressurized gas into the underwater animal will disable and render buoyant the underwater animal. To preclude the pressurized ejecting of the dart 22 from the associated underwater animal, a plurality of retaining flaps 66 are circumferentially mounted about the conical nose 56. To this end, each of the retaining flaps 66 is mounted at a forward end of the conical nose 56 about the center aperture extending therethrough by a U-shaped spring 68.

In use, the underwater dart gun 10 according to the present invention can be utilized underwater to effect disabling or killing of an underwater animal, such as a fish or the like, as desired. Because the dart 22 utilizes a pressurized gas, the dart can be utilized within either a fluid or gaseous medium. A plurality of the darts 22 can be positioned within the chambers 20 of the revolving magazine 18, with additional darts being stored within a storage compartment 70 integrally formed within the handle 16 of the gun body 12 and covered by a rotatable cover 72.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. In combination, an underwater dart gun and dart, said gun comprising:

a gun body for receiving said dart, said gun body being shaped so as to define a cylindrical bore;

means for piercing said frangible seal of said dart such that said dart accelerates from said gun body;

wherein said dart comprises a substantially cylindrical body with a rear end of said cylindrical body being shaped so as to define a nozzle having a frangible seal extending thereacross; and a pressurized gas contained within said cylindrical body, whereby said frangible seal can be punctured to permit expulsion of said pressurized gas from said cylindrical body through said nozzle to accelerate said dart from said gun body;

wherein said dart includes a dividing wall extending across an interior of said cylindrical body to separate said interior of said cylindrical body into a propellant chamber and an injection chamber; a frangible wall extending across the injection chamber; and a further pressurized gas contained within said injection chamber, and further wherein a front end of said cylindrical body of said dart is shaped so as to define a conical nose having a plurality of dispensing apertures directed through said conical nose to permit egress of said further pressurized gas contained within said injection chamber upon a puncturing of said frangible wall extending thereacross; and means for puncturing said frangible wall.

2. The combination underwater dart gun and dart of claim 1, wherein said conical nose of said cylindrical body terminates in a center aperture, and further wherein said means for puncturing said frangible wall comprises a piercing tip movably mounted relative to said conical nose through said center aperture, said piercing tip extending into said conical nose; a detonation pin coupled to said piercing tip and positioned for sliding engagement into said frangible wall such that an impacting of said piercing tip against an object will bias said piercing tip into said conical nose to cause said detonation pin to pierce said frangible wall to release said pressurized gas contained within said injection chamber through said dispensing apertures.

3. The combination underwater dart gun and dart of claim 2, wherein said dart further comprises a plurality of retaining flaps pivotally mounted about said conical nose.

4. The combination underwater dart gun and dart of claim 3, wherein said gun body further includes a barrel projecting therefrom.

5. The combination underwater dart gun and dart of claim 4, wherein said gun body is shaped so as to define a depending handle which can be grasped and manipulated by an individual.

6. The combination underwater dart gun and dart of claim 5, wherein said gun body further comprises a transverse aperture formed therein; and further comprising a revolving magazine rotatably supported within said transverse aperture formed in said gun body, said magazine including a plurality of chambers which can be rotatably positioned into alignment with said barrel.

7. An underwater dart gun for initiating propulsion of a dart having a pressurized gas contained by a frangible seal, said gun comprising:

a gun body for receiving said dart, said gun body being shaped so as to define a cylindrical bore;

a hammer slidably mounted within said cylindrical bore of said gun body, said hammer including a depending projection extending therefrom;

a hammer spring interposed between said hammer and a closed end of said cylindrical bore;

a trigger slidably mounted within said gun body, said trigger being mounted relative to said gun body so as to move in a non-parallel orientation relative to a longitudinal axis of said cylindrical bore, said trigger including a catch engagable to said depending projection to effect compression of said spring to a point where said catch disengages from said depending projection;

and, a firing pin mounted within said cylindrical bore and positioned for engagement with said frangible seal of said dart.

8. The underwater dart gun of claim 7, in combination with a dart, wherein said dart comprises a substantially cylindrical body with a rear end of said cylindrical body being shaped so as to define a nozzle having a frangible seal extending thereacross; and a pressurized gas contained within said cylindrical body, whereby said frangible seal can be punctured to permit expulsion of said pressurized from said cylindrical body through said nozzle to accelerate said dart from said gun body.

9. The underwater dart gun in combination with a dart of claim 8, wherein said dart includes a plurality of guide fins projecting from said rear end of said cylindrical body which cooperate to stabilize said dart during motion of said dart through a fluid medium by imparting a rotational spin to said dart.

10. The underwater dart gun in combination with a dart of claim 9, wherein said dart includes a dividing wall extending across an interior of said cylindrical body to separate said interior of said cylindrical body into a propellant chamber and an injection chamber; a frangible wall extending across the injection chamber; and a further pressurized gas contained within said injection chamber, and further wherein a front end of said cylindrical body of said dart is shaped so as to define a conical nose having a plurality of dispensing apertures directed through said conical nose to permit egress of said further pressurized gas contained within said injection chamber upon a puncturing of said frangible wall extending thereacross; and means for puncturing said frangible wall.

11. The underwater dart gun in combination with a dart of claim 10, wherein said conical nose of said cylindrical body terminates in a center aperture, and further wherein said means for puncturing said frangible wall comprises a piercing tip movably mounted relative to said conical nose through said center aperture, said piercing tip extending into said conical nose; a detonation pin coupled to said piercing tip and positioned for sliding engagement into said frangible wall such that an impacting of said piercing tip against an object will bias said piercing tip into said conical nose to cause said detonation pin to pierce said frangible wall to release said pressurized gas contained within said injection chamber through said dispensing apertures.

12. The underwater dart gun in combination with a dart of claim 11, wherein said dart further comprises a plurality of retaining flaps pivotally mounted about said conical nose.

13. The underwater dart gun in combination with a dart of claim 12, wherein said gun body further includes a barrel projecting therefrom.

14. The underwater dart gun in combination with a dart of claim 13, wherein said gun body further comprises a transverse aperture formed therein; and further comprising a revolving magazine rotatably supported within said transverse aperture formed in said gun body, said magazine including a plurality of chambers which can be rotatably positioned into alignment with said barrel.

15. A dart comprising:

a substantially cylindrical body with a rear end of said cylindrical body being shaped so as to define a nozzle having a frangible seal extending thereacross; and a pressurized gas contained within said cylindrical body, whereby said frangible seal can be punctured to permit expulsion of said pressurized from said cylindrical body through said nozzle to accelerate said dart from said gun body, said dart including a plurality of guide fins projecting from said rear end of said cylindrical body which cooperate to stabilize said dart during motion of said dart through a fluid medium by imparting a rotational spin to said dart, said dart including a dividing wall extending across an interior of said cylindrical body to separate said interior of said cylindrical body into a propellant chamber and an injection chamber; a frangible wall extending across the injection chamber; and a further pressurized gas contained within said injection chamber, and further wherein a front end of said cylindrical body of said dart is shaped so as to define a conical nose having a plurality of dispensing apertures directed through said conical nose to permit egress of said further pressurized gas contained within said injection chamber upon a puncturing of said frangible wall extending thereacross; and means for puncturing said frangible wall.

16. The dart of claim 15, wherein said conical nose of said cylindrical body terminates in a center aperture, and further wherein said means for puncturing said frangible wall comprises a piercing tip movably mounted relative to said conical nose through said center aperture, said piercing tip extending into said conical nose; a detonation pin coupled to said piercing tip and positioned for sliding engagement into said frangible wall such that an impacting of said piercing tip against an object will bias said piercing tip into said conical nose to cause said detonation pin to pierce said frangible wall to release said pressurized gas contained within said injection chamber through said dispensing apertures.

17. The dart of claim 16, wherein said dart further comprises a plurality of retaining flaps pivotally mounted about said conical nose.

* * * * *